US009162091B2

(12) United States Patent
Kuhnert

(10) Patent No.: US 9,162,091 B2
(45) Date of Patent: Oct. 20, 2015

(54) SAFETY HARNESS

(75) Inventor: Bradley A. Kuhnert, Poplar, WI (US)

(73) Assignee: Bradley A. Kuhnert, Poplar, WI (US)

( * ) Notice: Subject to any disclaimer, the term of this patent is extended or adjusted under 35 U.S.C. 154(b) by 2110 days.

(21) Appl. No.: 12/148,976

(22) Filed: Apr. 24, 2008

(65) Prior Publication Data

US 2008/0289903 A1 Nov. 27, 2008

Related U.S. Application Data

(60) Provisional application No. 60/928,414, filed on May 9, 2007.

(51) Int. Cl.
*A62B 35/00* (2006.01)

(52) U.S. Cl.
CPC ..... *A62B 35/0068* (2013.01); *A62B 35/0012* (2013.01)

(58) Field of Classification Search
CPC ..... A62B 35/04; A62B 35/0068
USPC ..... 182/3, 6, 7, 9
See application file for complete search history.

(56) References Cited

U.S. PATENT DOCUMENTS

| | | | | | |
|---|---|---|---|---|---|
| 1,971,571 | A * | 8/1934 | McMullen | ..... | 182/9 |
| 4,103,758 | A * | 8/1978 | Himmelrich | ..... | 182/3 |
| 4,478,311 | A | 10/1984 | Anderson | ..... | 182/3 |
| 4,687,074 | A | 8/1987 | Green | ..... | 182/3 |
| 4,923,048 | A * | 5/1990 | Cole | ..... | 182/9 |
| 4,951,778 | A * | 8/1990 | Halvorson | ..... | 182/9 |
| 5,050,704 | A * | 9/1991 | Olsson | ..... | 182/9 |
| 5,052,514 | A * | 10/1991 | Rezmer | ..... | 182/9 |
| 6,223,854 | B1 * | 5/2001 | Nolz | ..... | 182/3 |
| 6,637,547 | B1 | 10/2003 | Wydner | ..... | 182/3 |
| 6,874,596 | B2 | 4/2005 | Zeissier et al. | ..... | 182/3 |
| 6,973,995 | B1 * | 12/2005 | Diggle, III et al. | ..... | 182/9 |
| 6,981,571 | B2 * | 1/2006 | Diggle | ..... | 182/9 |
| 7,163,081 | B2 * | 1/2007 | Muhich | ..... | 182/3 |
| 2004/0200666 | A1 * | 10/2004 | Diggle et al. | ..... | 182/9 |
| 2005/0139419 | A1 * | 6/2005 | Green | ..... | 182/3 |
| 2006/0207828 | A1 | 9/2006 | D'Acquisto | ..... | 182/3 |
| 2009/0314578 | A1 * | 12/2009 | Hede et al. | ..... | 182/3 |
| 2010/0051382 | A1 * | 3/2010 | Schlief | ..... | 182/9 |
| 2011/0214941 | A1 * | 9/2011 | Petty et al. | ..... | 182/9 |

OTHER PUBLICATIONS

Modern Language Association (MLA): "grommet." Dictionary.com Unabridged. Random House, Inc. Feb. 11, 2011. <Dictionary.com http://dictionary.reference.com/browse/grommet>.*
http://www.merriam-webster.com/dictionary/tether.*

* cited by examiner

*Primary Examiner* — Katherine Mitchell
*Assistant Examiner* — Candace L Bradford

(57) ABSTRACT

The present invention generally relates to a safety restraint suitable for restraining the hunter to a tree in a deer stand. The safety harness of the invention comprises a iii) user member for connecting to the user, iv) an anchor member for attachment to a tree or other suitable generally vertical stand mounting member and iii) a connecting member which cooperatively connects the user and anchor members, wherein connected to said anchor member is a round and/or oval shaped ring sewn into the anchor strap material. The connecting member which is attached to the user member is connected to the D-ring or round and/or oval shaped ring attached to said anchor member.

1 Claim, 6 Drawing Sheets

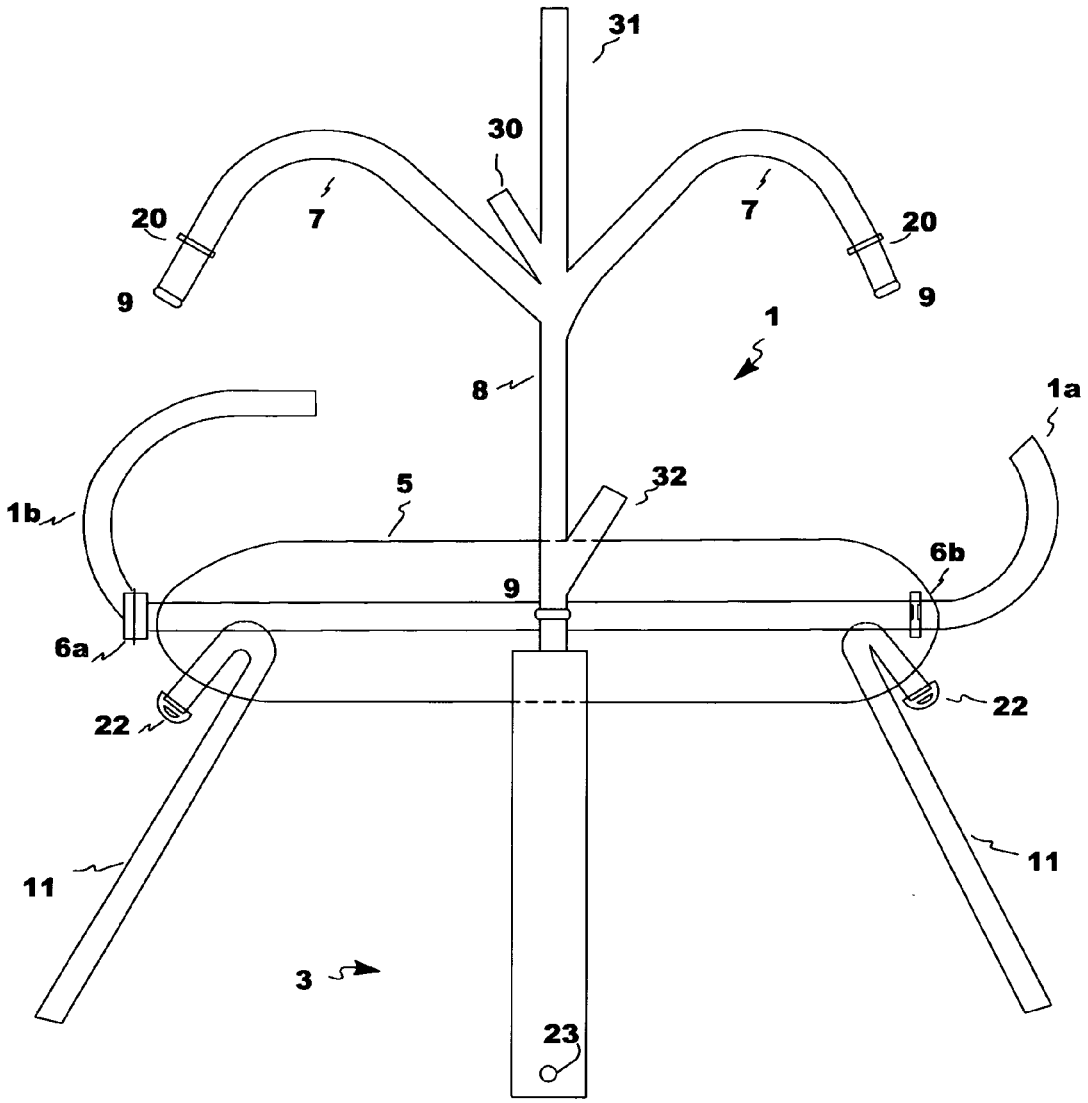
FIG. 2
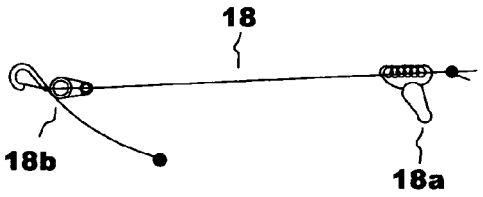

SAFETY HARNESS

The present application claims benefit of U.S. provisional application No. 60/928,414 filed on May 9, 2007.

FIELD OF THE INVENTION

The present invention relates to a safety restraint device, and more particularly, to a safety harness used by hunters to prevent accidental falls when using a tree stand.

BACKGROUND OF THE INVENTION

It has been quite popular with hunters to utilize tree stands or platforms above the ground to aid in hunting. In order to prevent individuals from falling from elevated platforms, such as tree stands, a number of different types of safety devices have been developed. One example of a safety device is a harness that is attachable to the tree or other support on which the individual is standing. If the individual happens to fall off of the platform, the harness, because it is attached to the support, operates to stop the fall of the individual after a short distance in order to prevent the individual from striking the ground.

While many prior art harnesses engage to stop the fall of an individual, the harness exerts an instantaneous and significant force on the body of the individual in a direction directly opposite to the direction in which the individual is falling. The magnitude of this force can often cause injury to the individual depending upon both the size of the individual and the length of the fall traveled by the individual, i.e., the momentum of the individual, before the engagement of the harness. Even after the fall the individual is now hanging from their harness but has no way to pull themselves back up onto the platform they feel off of which in a short period of time hanging from their harness in this manner could cause them to die from suspension trauma. In addition, some prior art safety harness can sometimes suspend individuals in other than an upright position, which is not desirable for obvious safety reasons.

In addition to stopping the fall of an individual, it is desirable that the safety harness, when engaged, suspend the individual in an upright position for obvious safety reasons.

The present invention offers an improved safety restraint device that fills a need in the art for a simple, effective, inexpensive, easy to use device which is not hampered by noise or lack of flexibility of movement. The present safety system when worn facing the tree such as a climbing belt better absorbs the shock of a fall and when engaged, suspends the individual in an upright seated position. If so desired the present invention can be worn as a climbing belt or it can also be worn as a traditional 6 point safety harness. The difference between the present invention and today's safety harnesses is in case of a fall that the present invention allows you to pull yourself up when worn and used properly. The anchor member and connecting member of this invention could also be incorporated and used with the prior art harnesses used today for added safety reasons that may prevent individuals from dying from suspension trauma.

SUMMARY OF THE INVENTION

The present invention generally relates to a safety restraint suitable for restraining the hunter to a tree in a deer stand or user to a pole. The safety harness of the invention comprises a i) user member for connecting to the user, ii) an anchor member for attachment to a tree or other suitable generally vertical stand mounting member and iii) a connecting member which cooperatively connects the user and anchor members.

The user and anchor members include a strap and buckle wherein the buckle may or may not include a release strap. The connector member includes a connector strap having two links, the links being located at opposite ends of the connector strap, where the user member is operatively connected to the first link and the anchor member is cooperatively connected to the second link. The user member is preferably placed around the waist of the user and adjusted by means of the buckle. The user member for connection to the user preferably comprises a waist belt and strap cooperatively connected to a buckle or 3 bar slide means for adjusting said strap to fit the user wherein said buckle means may also include a release strap for aiding in the release of said user member from the user, whereby activation of said release strap enables release of said strap from said buckle means. The user member has a second strap that goes around the waist of the user and is attached to the anchor member and adjusted by means of a buckle. Alternatively, the user member can include shoulder straps with tethers a sling or seat-like attachment that can suspend the hunter in a seated, upright position in the event of a fall.

A major difference between the harness of the invention and prior art harnesses is that with the present harness it is preferable that the hunter be facing the tree, not with his back to the tree as you are with many of the harnesses sold today, but this harness could also be used as a 6 point safety harness if so desired.

DETAILED DESCRIPTION OF THE INVENTION

The invention relates to a safety restraint device of a configuration and shape particularly suitable for use by hunters in treestands, wherein the device is used to secure the user to the tree so that the user may move about freely without fear or possibility of falling from the stand. Those skilled in the art will recognize that treestands are typically utilized approximately 10 to 25 feet above the ground thereby inducing anxiety of falling or inadvertent falls. As those skilled in the art will recognize, treestands are well known in the art and therefore, will not be described further herein.

The anchor member (2) is connected to a tree or other suitable object. The anchor member (2) strap is generally 1 to 4 inches wide, and attached thereto is a round or oval ring approximately 3-5" (4) in diameter and a D-ring (13) is attached approximately 3.5" from the round or oval ring (4). The strap has a buckle on one end and on the opposite end it has a round metal grommet about 1" from the end. The 3" round/oval ring and D-ring are attached/sewn in such a manner that the strap first goes through the rings and then approximately 12-15" of the strap is threaded through a buckling means. This 12-15" of strap is then doubled through the buckle and is sewn with approximately a 2-4" opening that starts approximately 4" from end of buckle that the 3" round ring is contained therein. The ring/rings are sewn such that the ring/rings are pulling against the main strap and not the 15" sewn portion. The D-ring is sewn with a very tight opening to fit the D-ring so it cannot slide. By having the round ring sewn directly to the strap in this manner, there is only a 3" opening or so, which does not allow the ring to slide freely on the main strap. See FIG. 6. By having an approximate 3" opening, which contains the round ring mentioned above does two things. First it allows the user safe motion from side to side. If this 3" opening was not there and the ring was allowed to slide freely along the strap as the user moved side to side the user could loose their balance and fall. In the hunting world this opening allows safe side to side or up and down movement but without noise. If this round ring was sewn tightly on each side to the strap, as it pivoted to the left or right as the hunter moved it would create noise as it rubs against the sides of the strap it was sewn to. By using a 3" round ring you also get smooth and quiet movement at all times. You could use a D-ring but with a D-ring sewn in this manner you could run into problems. As you get tension against the D-ring the strap at times folds over itself in the sharp bends of the D-ring causing noise for a hunter and a potential safety factory for the user as wear on the strap the ring is attached to may start as they rub against each other more and more. Accordingly, a round or substantially round ring sewn to a main strap or belt in this manner is a better choice than a D-ring, in this application, although one could use a D-ring if necessary. It allows for a smooth, quiet and safe operation. In the hunting world anything that operates smooth, quiet and safe is something that the hunter is always looking for.

The D-ring that is sewn to the anchor strap serves multiple purposes. First, it can be used as a place to attach a connecting means such as a spring snap hook/carabiner with an adjustable knot that is attached to one end of a rope or wire and attached on the other end of this rope or wire is a connecting means such as a carabiner which is attached to the end of the anchor member strap by means of a round grommet about 1" from the end of the strap. If carabiner is not used to connect to end of strap this end could be tied through metal grommet with proper knot. This is used as a safety feature so the end of strap on the anchor member cannot accidentally be pulled back through the buckle. Second, this is a place where a connecting means such as a spring snap hook or carabiner is attached to a length of rope by an adjustable knot and is connected to the D-ring on one end and the other end is connected to the user member waist strap. This acts as a secondary safety device in the event that the primary safety strap through the round ring fails.

The D-ring is also a place where the connecting member could be connected to by means such as a rope, which on one end has a carabiner and pulley hoist connected to the D-ring and the other end of the rope is attached to the end of the connecting member strap through the round grommet at end of connecting member by means such as a prusik knot and carabiner. Those skilled in the art could see how this anchor member and connecting member could be incorporated with today's harnesses for added safety reasons.

The user member is generally a belt type fastener which has two separate main straps or webbing approximately 2" wide, which are attached to a wider foam waist belt. One strap approximately 64" long is attached to user member foam waist belt and goes around the waist of the user and is attached by means of a buckle or 3 bar slide that is attached to the side of user member foam waist belt, which will allow for adjustment. The second strap is another approximately 2" wide and 74" long piece of strap or webbing that is attached also to the foam waist belt. This second strap runs from one side of the waist belt and across the users back to the other side, then the strap runs through the 3" round ring on anchor member that is attached to the tree or pole and is then threaded through a buckle or 3 bar slide which is attached to the side of the user member waist belt. This will allow the user to make the proper length adjustment as compared to the size platform or device that the user is standing on. The user can now lean back against the foam waist belt, which should be a minimum of 4-6" wide but can be wider. With this belt now around the user's waist and through the round ring to support the user the user can now move from side to side or up and down in a smooth, quiet motion not worrying about the strap making noise as he or she moves. This design will now allow for safe and controlled movement as the user moves from side to side. As you can see if the round ring was allowed to slide freely on the main strap around the tree or pole as the user leaned or moved from side to side he or she could be thrown from the pole or tree. This design creates a V shape as the belt goes around the user's waist and hip area and through the round ring, allowing for smooth, quiet and safe operation. This user member has a 4-10" tether located in the center of the waist belt, for safety reasons. An advantage of having a large round ring attached to the anchor member strap is in event that the user fell from the device or platform he or she was standing on the larger round ring would allow the user a place to grab and pull them self up. This round ring would also allow a place to attach the connecting member to in case of a fall. In some cases this may actually save the users life in that it allows the user to avoid suspension trauma by pulling themselves up thus relieving the pressure put around there legs from the leg straps on most harnesses today.

The user member can also include a sling or seat-like attachment approximately 5-10" wide and 32" long that can suspend the hunter in a seated, upright position in the event of a fall. In this design, the lower seat strap/attachment is connected to the main waist belt by means of a buckle/3 bar slide on one side for adjustment. The user member may also have optionally two leg straps attached to it that will go around user's legs. The leg straps are sewn to each side of waist belt. The straps go around each leg and are crisscrossed through the crotch area and then are fastened to a buckle or fed through (2) D-rings or 3 bar slides that are attached on each side of waist belt also. This crisscrossing of these leg straps is very important in case of a fall. This lower sling or seat-like attachment does several things. First it allows the user to sit down on the lower seat allowing the user to relieve stress on the leg and back muscles. This kind of design also allows the user more freedom and quiet movement than if the waist belt and lower seat were all one piece. Another reason for this lower seat would be in case the user fell from the platform or device he or she was standing on. In case of a fall this lower seat with the leg straps properly crisscrossed would not allow the user to fall to the ground. Most importantly in case of a fall the user would now be facing the tree or pole and in a seated position. Being in a seat position plus having the round ring to grab hold of for support if needed would decrease the chance of death from suspension trauma and would not be as likely to happen as it is today with many harnesses on the market today The user member could also have optional shoulder straps with tethers attached which could allow the harness to be worn as a 6 point safety harness also, if so desired. The tethers and shoulder straps would be approximately 2" wide webbing which would be attached to the user member waist strap and or waist belt. This could be done by open loops on all ends and by using a buckle/3 bar slide for adjustment. In one embodiment there are two tethers where in the first tether is a traditional tether, which is approximately 24" long, from where the shoulder straps separate. This tether is where the strap that would connect the harness to the tree or pole would be connected. There would also be a second shorter tether 5-12" long, which would be used for safety reasons. In case of a fall by having a length of rope with a connecting means on each end such as a carabiner and prusik knot on one end attached to the short tether and on the other end a snap hook or carabiner connected to a small pulley hoist which then could be connected to the anchor members round ring or D-ring. The user could now pull themselves up which would prevent the user from dying of suspension trauma.

The connecting member is a separate strap approximately 3-6" wide and approximately 30" long that is optionally wider in the middle, with one end attached in the middle of the waist belt and or waist strap. This could be attached to the front or back side of waist strap. Said strap may also have an optional D-ring attached also. At the other end of the strap is a round metal grommet located in the middle of the strap and approximately 1" from the end of the strap. Attached to this metal grommet is a cord, or rope that is approximately 3-6' long or longer. Attached at one end of this rope is a pulley hoist with a connecting means such as carabiner or snap hook connected to the D-ring or round ring that is attached to anchor member and the other end has an adjustable knot, such as a Prusik knot with a carabiner attached to a round grommet at the end of the connecting member. With the connecting member attached in this manner it can act as a seat and possibly prevent a fall. In case of a fall, if the connecting member was not already attached to anchor member before the fall, given the proper length of rope and with the connecting devises mentioned previous the rope could be run through the users legs or around both legs and connected to the round ring or D-ring which are connected to the anchor member, which is attached to a tree or pole. Once this connecting member strap is attached to the anchor members round ring or D-ring the user can then pull the rope through the pulley and carabiner system (pulley hoist) or prusik knot. By pulling them self up in this manner this connecting member strap will help cradle the user into more of a seated position. By being able to use the connecting member and anchor member in this manner would again help prevent the user from dying from suspension trauma if they fell from the platform they were standing on.

One of the major problems today with many of the harnesses sold in the market is that if the user were to fall from a treestand, the harness might initially save the users life by preventing the user from falling to the ground, but if the user has no means to pull him/her self up, they could die from suspension trauma in as little as 30 minutes. With the design of the present invention, this would not happen in that the user has several possibilities to pull them self up. More particularly, a major advantage of the design of the present invention compared to many other designs is that in the case of a fall, the risks of dying from suspension trauma are greatly reduced. With the present design when used properly the user would not fall straight down and hang from your harness; rather, the user would fall forward into the tree or pole, thereby facing the tree or pole in a somewhat seated position. With the round ring to grab hold of and help pull yourself up to situate your weight the user now can shift his or her weight around and sit in the harness until help arrives. If used properly the connecting member used in conjunction with the anchor member as stated above could be used as an accessory to many of the harnesses on the market today. These 2 members could help prevent death's that are occurring today from suspension trauma when a user falls from the platform they were standing on.

While the present invention will be described with respect to a preferred configuration of the device, and with respect to preferred materials and shapes of construction, it will be understood that other configurations, materials, and shapes could be used for constructing the safety devices, without departing from the spirit and scope of the invention. Various advantages and features of novelty which characterize the invention are pointed out with particularity in the claims annexed hereto and which form a part hereof. However, for a better understanding of the invention and its advantages obtained by its use, reference should be made to the drawings which form a further part hereof and the accompanying descriptive matter in which there is illustrated and described a preferred embodiment of the invention.

BRIEF DESCRIPTION OF THE DRAWINGS

Referring to the drawings, wherein like numerals represent like parts throughout the several views:

FIG. 2 is a view of the device disclosed in FIG. 1 with leg straps instead of a sling seat.

As shown in FIGS. 1-6 in one embodiment, the safety harness of the invention includes user member (1) for connecting to the user, an anchor member (2) for attachment to a tree or other suitable generally vertical stand mounting member and a connecting member (3) which cooperatively connects the user and anchor members. Connected to said anchor member (2) is a round and/or oval shaped ring (4) and a D-ring (13) sewn into the anchor member material. The connecting member (3) connects the user member (1) to the D-ring, (13) attached to said anchor member (2).

Figure 1:
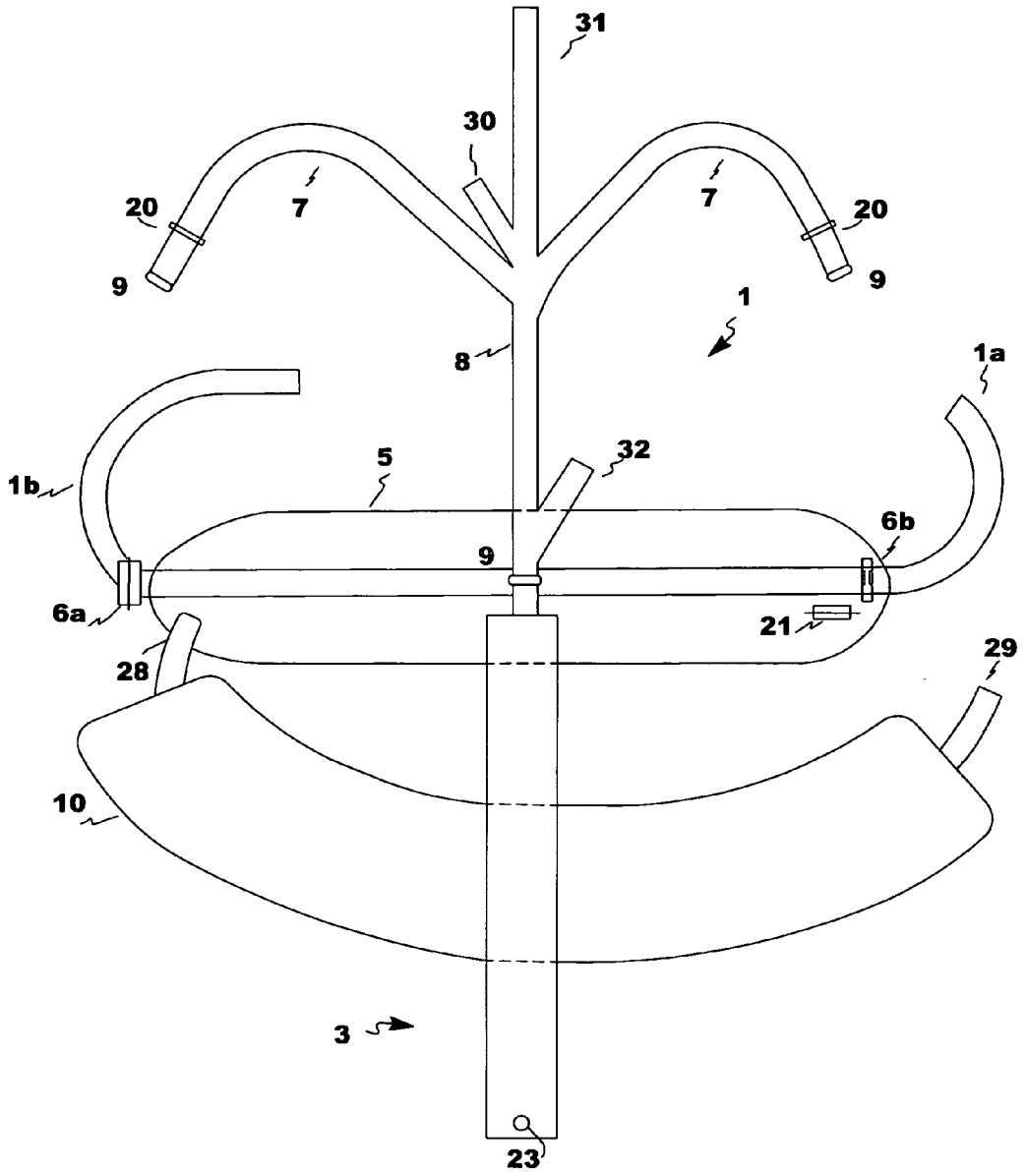
FIG. 1 is a view of an example of the usage of the safety restraint device constructed according to the principles of this invention, said safety restraining device having a sling seat.

The user member (1) is preferably in the form of a waist belt (5) approximately 5-10" wide that is formed around the users waist and made of a suitable material, such as polar fleece, foam, nylon or canvas, among others, and that can include a separable closure. Attached to and around the foam waist belt are 2 separate pieces of webbing/waist strap (1*a*) and ring strap (1*b*) attached on top of each other, This will form a belt like loop. The end of waist strap (1*a*) is to be placed around the user's waist as shown in FIG. 1. Strap (1*a*) goes around the user's waist and through a buckle/3 bar slide (6*a*) that is attached to the end of waist strap (1*a*) which is attached to waist belt (5) user member (1). This will allow for adjustment around waist. Very important now, Ring strap (1*b*) goes through round ring (4) which is attached to anchor member (2). Ring strap (1*b*) is then treaded through a 3 bar slide (6*b*) which is attached to user member (1) waist belt (5). This will allow for adjustment to what distance the user wants to be from the anchor member (2), which is attached to a tree or pole. The user member has a tether (32) approximately 2" wide and 4-10" long attached in the center of the waist belt for safety reasons. It should be noted that any other means for connection of members 1 and 2 which can be envisioned in the spirit and scope of this invention may be used.

Another alternative is to have a single strap (8) attached about the middle of the back by an open loop on the end of strap (8) which will form a half hitch knot around straps (1*a*) and (1*b*) which are on waist belt (5) user member (1). Strap (8) will come up approximately half way up the user's back and then separate into two shoulder straps (7). These shoulder straps are then run over the shoulder. These shoulder straps are not sewn to the waist belt instead they have open loops (9) on them in which the waist belt (1*a*) runs through these open loops and is then attached to some type of fastening means, for example, a buckle (6*a*). On these shoulder straps (7) are 3 bar slides (20) that allow the user to make length adjustments on these straps. By not permanently attaching these shoulder straps to the waist belt it will allow this harness to fit a wider range of waist sizes that the users may have.

Referring to FIG. 1, the user member can also include a sling or seat-like attachment (10) that can suspend the hunter in a seated, upright position in the event of a fall. In this design, a lower seat strap (10) is connected to the main waist belt (5). The lower seat (10) is attached/sewn on one end by a 2-7" long 2" wide piece of webbing (28) and the other end of the strap (29) is attached to a buckle/3 bar slide (21) which is attached to waist belt (5) for adjustment. Optionally two leg straps (11) FIG. 2 could be attached. These leg straps (11) are a piece of webbing/strap 2" wide and approximately 60" long that are sewn to each side of the waist belt (5). These leg straps (11) are then crisscrossed around the user's legs and through the crotch area and then attached to the waist belt (5) by D-rings (22) or 3 bar slides/buckle. The crisscrossing of the leg straps in combination of the lower seat help to relieve stress on the leg and back muscles, and with the leg straps properly crisscrossed would not allow the user to fall to the ground.

Referring to FIG. 2 the connecting member (3) is sewn to or attached by open loop and connected to the user member (1) waist belt (5) or and to waist straps (1*a*) and (1*b*). The connecting member (3) and anchor member (2) are attached by a length of rope (18) with a prusik knot and snap hook or carabiner (18*a*) attached on one end and the other end of the rope would have a small pulley hoist and carabiner or snap hook (18*b*) attached. One end (18*a*) of rope (18) is attached to round grommet (23) the other end (18*b*) is connected to the D-ring (13) or round and/or oval shaped ring (4) attached to said anchor member (2). The total length of the connecting member assembly can be varied by rope (18) and connecting member (18*a*) such that the user can vary the distance he/she wishes to be from the tree to which the anchor member (2) is attached. It should be noted that any other means for connection of members 1, 2 and 3 which can be envisioned in the spirit and scope of this invention may be used.

Figure 4:
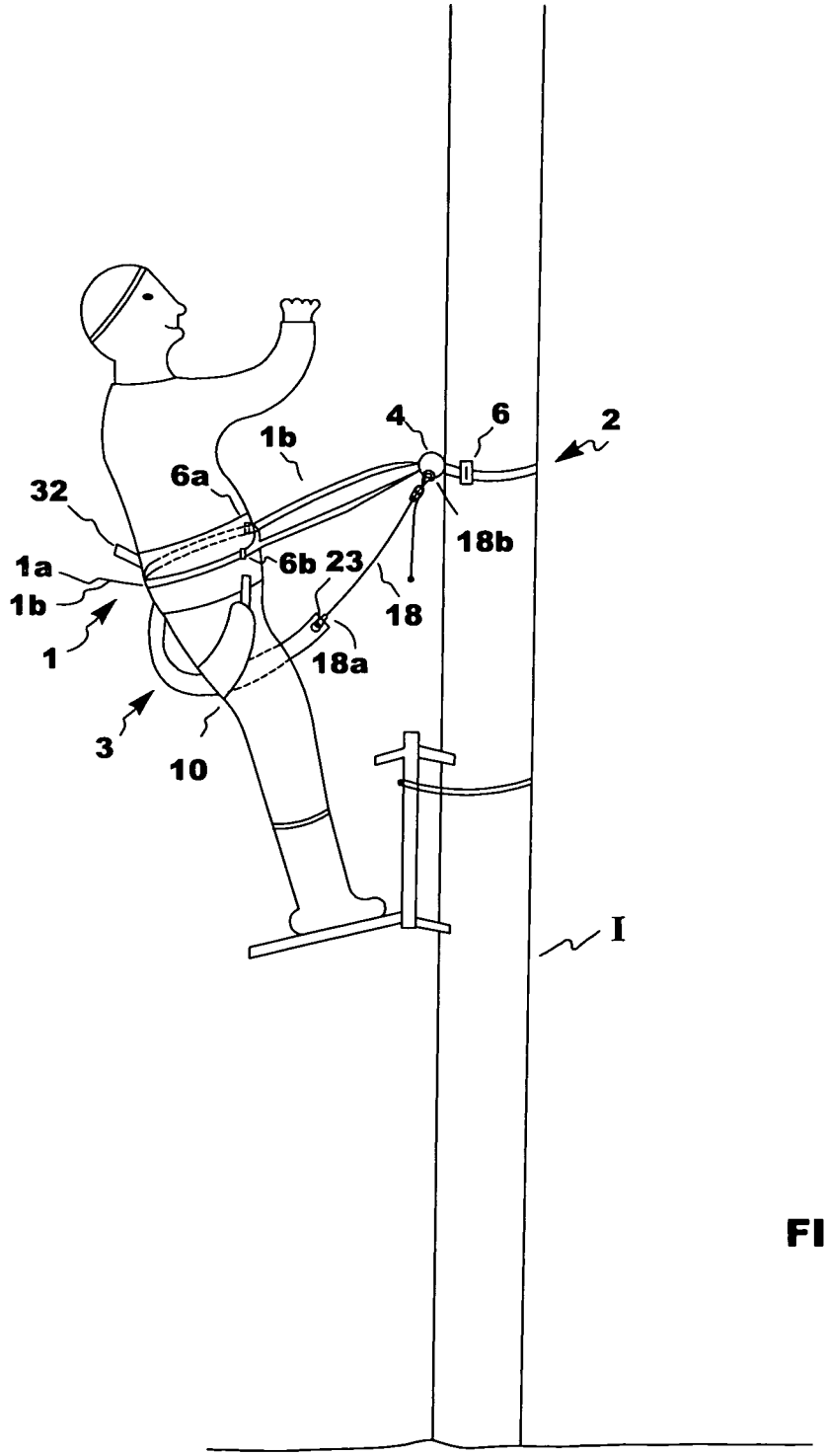
FIG. 4 is a view of the user in the harness being worn facing the tree.

In operation, the device is used in the manner generally shown in FIG. 4. The device is utilized to anchor the user to a tree or other affixed object (I) to allow movement of the user while preventing an accidental or otherwise inadvertent fall.

Figure 3:
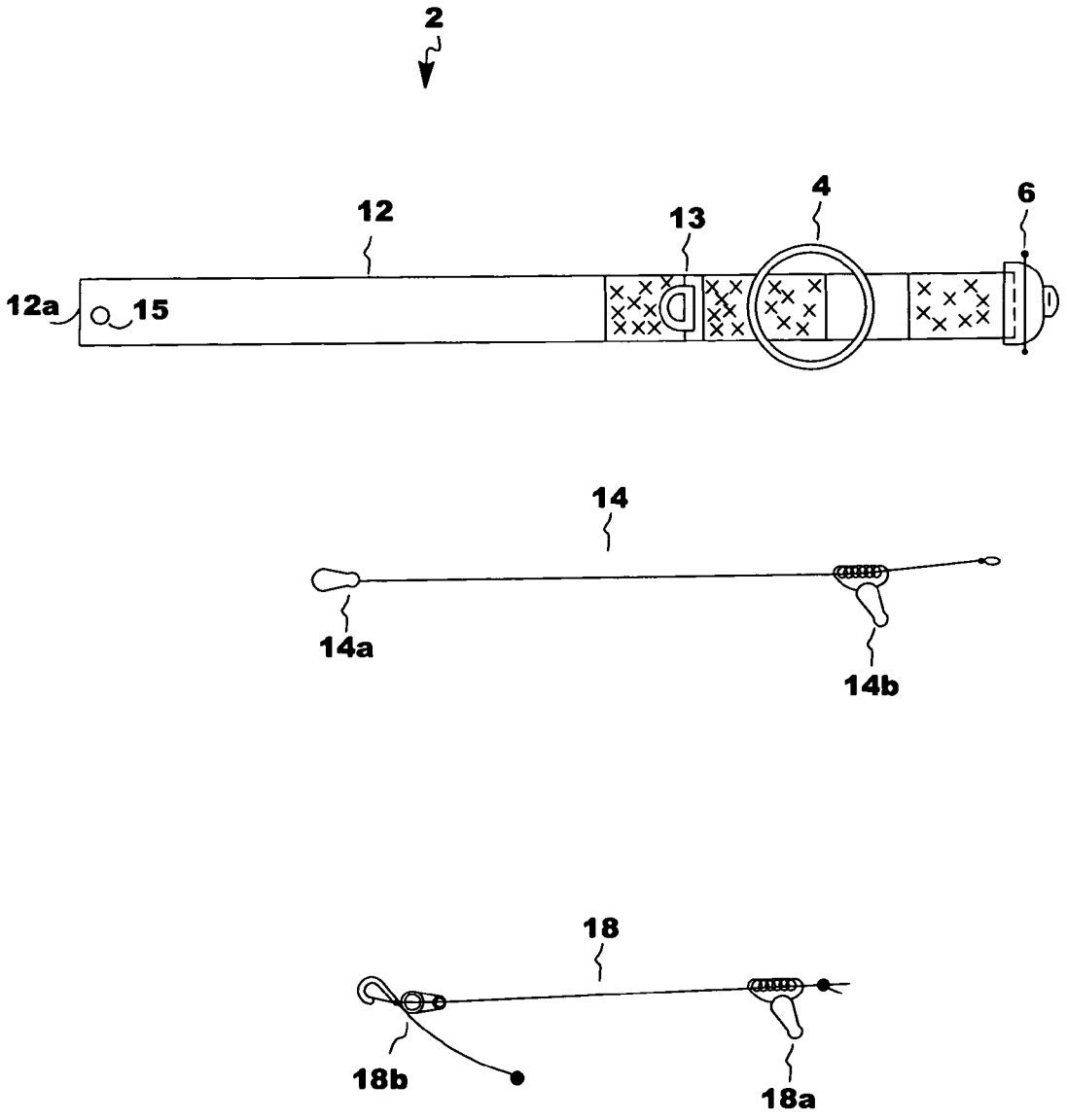
FIG. 3 is a view of the anchor member according to the invention

FIG. 3 To utilize device, typically, the user will attach anchor member (2) by wrapping the strap (12), around a tree, and feeding the end (12*a*) of the anchor member strap (12) into a buckle (6) or other type of attachment means, thereby securely attaching the anchor member to the tree. This should be done before climbing up a tree or pole. For added safety attach rope (14). Take end (14*a*) and attach through the round metal grommet (15) on anchor member. Take the other end of rope (14) by means of a prusik knot and carabiner (14*b*) and attach it to D-ring (13) on anchor member (2).

FIG. 4 Before climbing a tree or pole the user will attach user member (1) to anchor member (2). FIG. 2 The user will take strap (1*a*) on user member (1) and wrap it around his or her waist. The user will then tighten the strap through buckle (6*a*) on user member (1) to a comfortable and secure position in the same manner as noted above. The user will then take strap (1*b*) on the user member (1) and run it through the round ring (4) on anchor member (2) and connect it to a 3 bar slide/buckle (6*b*) on user member. The user can now adjust strap (1*b*) on user member (1) to a comfortable and safe distance from tree or pole. Finally for added safety the user will attach the connecting member (3), which is optionally sewn into the user member (1), or otherwise disengage ably attached to the user member (1). The user will then connect the end of rope (18) by means of a prusik knot and carabiner (18*a*) to the round metal grommet (23) on connecting member (3). The other end of rope a carabiner and pulley hoist (18*b*) is connected to the D-ring (13), or oval ring (4) of the anchor member (2) and this can now be adjusted to the proper length. The user is now secured to the tree or other stationary and ready to climb and stand on platform. See FIG. 4. The aforementioned steps should normally be done before user attaches anchor member (2) to tree, and the user member (1) should remain attached through ring (4) at all times. The user is now ready to move about the tree because of the friction free sliding action provided by the cooperative connection of the anchor member (2) to the user member (1) through the round ring (4) on the anchor member (2). The connecting member (3) is also connected to the anchor member (2) for added safety. The present invention also allows the user to turn freely if desirable. The device allows the user to move freely, yet, the movement creates no noise due to the materials and friction free construction of the invention.

Figure 5:
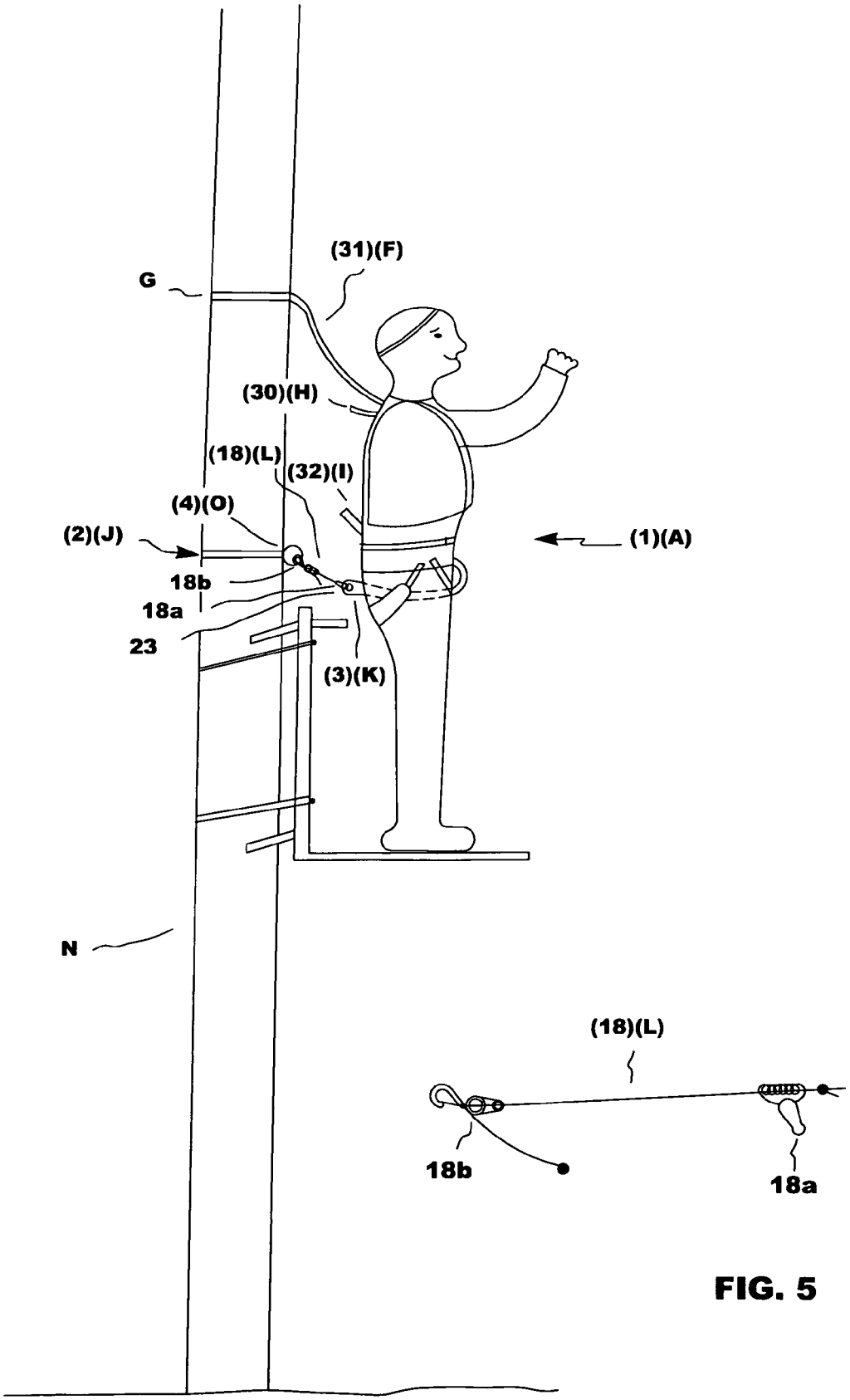
FIG. 5 is a view of the user in the harness being worn as six point safety harness.
Figure 6:
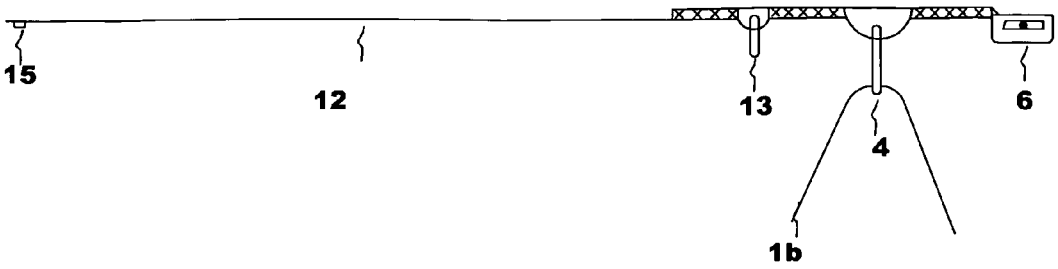
FIG. 6 is a detail view of anchor member.
Figure 6:
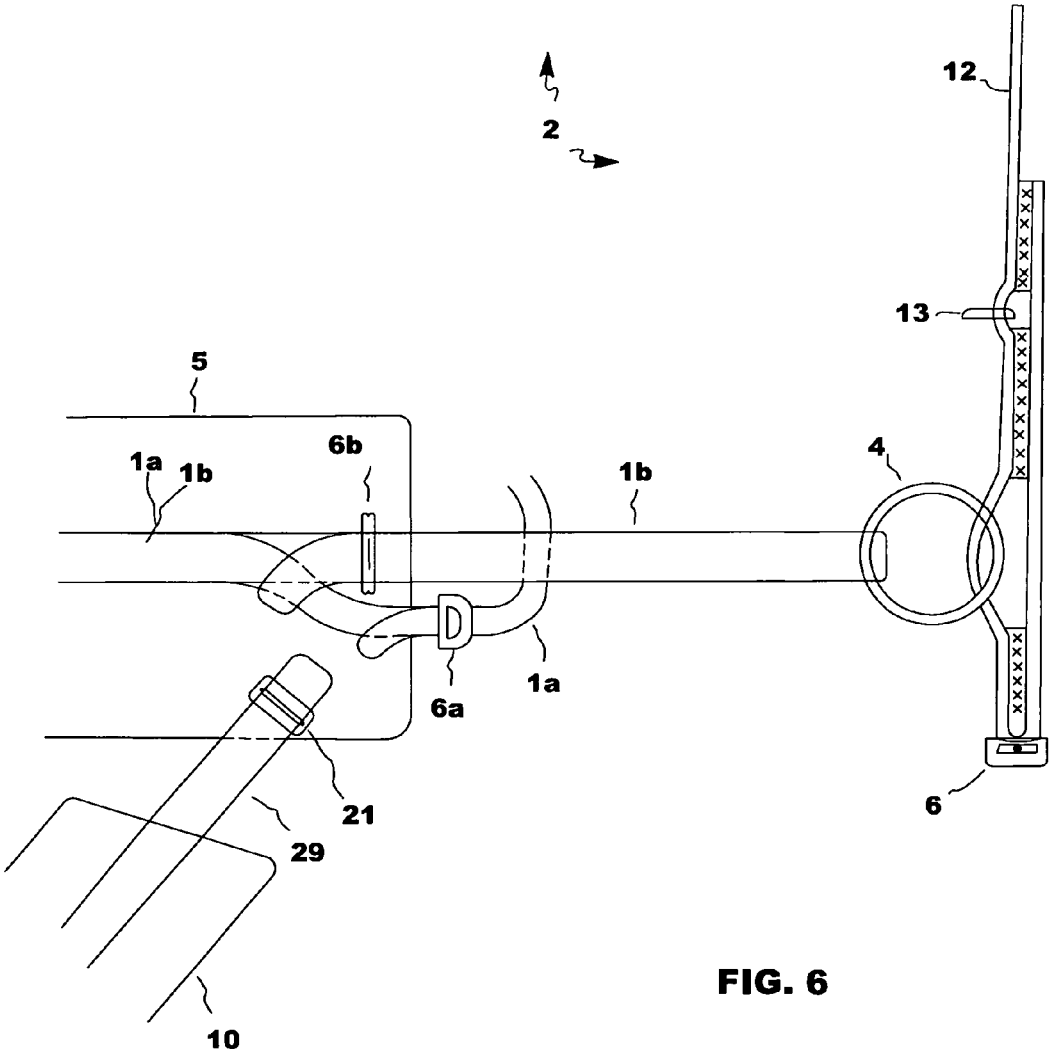

Because the user is secured to the tree or other object, he or she may lean back or to the side and take aim at game which would not be possible without restraint. The device offers advantages for bow and rifle hunters as well as observers and photographers who wish to prevent an accidental fall. This invention also has the ability to be used as a six-point safety harness. See FIG. 5. In this embodiment the user member (1) (A) is attached around the users waist and is also connected to a tree or pole (N) by a strap (G) the runs through open loop in long tether (31) (F). The anchor member (2) (J) is connected around the tree or pole (N). Anchor member (2) (J) is connected to connecting member (3) (K) by means of rope assembly (18) (L) with a connecting means, prusik knot and carabiner (18*a*) attached to grommet (23) on connecting member (3) (K). The other end of rope (18) with connecting means, pulley hoist with carabiner/snap hook (18*b*) is connected to round ring (4) (O) which is attached to anchor member (2) (J). The anchor member (2) (J) along with rope assembly unit (18) (L) with connectors (18*a*) and (18*b*) used along with short tether (30) (H) and or short tether (32) (I) could be used in conjunction with today's harnesses to help prevent death's from suspension trauma.

It is believed that the invention, its mode of operation, construction, and assembly and many of its advantages should be readily understood from the foregoing without further description. While a particular embodiment of the invention has been described, other modification of the invention will be apparent to those skilled in the art in light of the foregoing description. This description is intended to provide specific examples of embodiments of the present invention. Accordingly, the invention is not limited to the described embodiments or to the use of specific elements therein. All alternative modifications and variations of the present invention which fall within the spirit and broad scope of the appended claims are covered.

What is claimed is:

1. An anchor strap for use with a safety harness, said anchor strap (2) containing a round or substantially round shaped ring (4) sewn into the anchor strap such that the round or substantially round shaped ring cannot slide along said anchor strap, wherein said round or substantially round shaped ring (4) is employed to cooperatively connect the anchor strap to the safety harness and wherein said anchor strap additionally comprises a round metal grommet or D-ring attached to said anchor strap, said grommet or D-ring attached approximately 4 inches from the round or substantially round ring (4).

* * * * *